US008003873B2

(12) United States Patent
Rasker

(10) Patent No.: US 8,003,873 B2
(45) Date of Patent: Aug. 23, 2011

(54) PERCUSSION ASSEMBLY, AS WELL AS DRUMSTICKS AND INPUT MEANS FOR USE IN SAID PERCUSSION ASSEMBLY

(76) Inventor: Hubertus Georgius Petrus Rasker, Oeffelt (NL)

( * ) Notice: Subject to any disclaimer, the term of this patent is extended or adjusted under 35 U.S.C. 154(b) by 127 days.

(21) Appl. No.: 12/310,894

(22) PCT Filed: Sep. 12, 2007

(86) PCT No.: PCT/NL2007/000222

§ 371 (c)(1),
(2), (4) Date: Mar. 11, 2009

(87) PCT Pub. No.: WO2008/033012

PCT Pub. Date: Mar. 20, 2008

(65) Prior Publication Data

US 2009/0320672 A1 Dec. 31, 2009

(30) Foreign Application Priority Data

Sep. 12, 2006 (NL) ..... 1032483

(51) Int. Cl.
*G10H 1/36* (2006.01)

(52) U.S. Cl. ..... 84/610; 84/104; 84/411 R; 84/611; 84/634; 84/635; 84/650; 84/651; 84/666; 84/667

(58) Field of Classification Search ..... None
See application file for complete search history.

(56) References Cited

U.S. PATENT DOCUMENTS

| | | | | |
|---|---|---|---|---|
| 3,878,751 | A | 4/1975 | Golden et al. | |
| 4,235,144 | A | 11/1980 | Brand et al. | |
| 4,819,536 | A | 4/1989 | Lombardi | |
| 5,062,341 | A * | 11/1991 | Reiling et al. | 84/702 |
| 5,115,706 | A | 5/1992 | Aluisi | |
| 5,192,823 | A * | 3/1993 | Suzuki et al. | 84/600 |
| 5,777,251 | A * | 7/1998 | Hotta et al. | 84/609 |
| 6,175,070 | B1 | 1/2001 | Naples et al. | |
| 7,019,206 | B2 * | 3/2006 | Mishima | 84/723 |
| 7,589,275 | B2 * | 9/2009 | Arimoto | 84/723 |
| 7,667,130 | B2 * | 2/2010 | Mishima | 84/723 |
| 7,795,518 | B2 * | 9/2010 | Yoshino et al. | 84/411 R |
| 2001/0015123 | A1 * | 8/2001 | Nishitani et al. | 84/615 |
| 2004/0025663 | A1 * | 2/2004 | Harada et al. | 84/104 |
| 2004/0083873 | A1 * | 5/2004 | Yoshino et al. | 84/107 |
| 2005/0223880 | A1 * | 10/2005 | Yoshino et al. | 84/738 |
| 2005/0257672 | A1 * | 11/2005 | Arimoto | 84/738 |
| 2005/0262991 | A1 * | 12/2005 | Arimoto | 84/735 |
| 2006/0219092 | A1 * | 10/2006 | Mishima | 84/724 |
| 2009/0000464 | A1 * | 1/2009 | Mishima | 84/724 |
| 2009/0013857 | A1 * | 1/2009 | Ramstein | 84/645 |
| 2009/0241755 | A1 * | 10/2009 | Yoshino et al. | 84/421 |
| 2010/0180755 | A1 * | 7/2010 | Copeland et al. | 84/622 |

FOREIGN PATENT DOCUMENTS

| | | |
|---|---|---|
| GB | 8712 | 9/1908 |
| GB | 2204727 A | 11/1988 |

* cited by examiner

*Primary Examiner* — Marlon T Fletcher
(74) *Attorney, Agent, or Firm* — Wood, Phillip, Katz, Clark & Mortimer

(57) ABSTRACT

The present invention relates to a percussion assembly comprising a multitude of percussion instruments, means for playing said percussion instruments and input means for inputting a tone pitch selection for the purpose of producing a tone pitch selection signal. The percussion assembly further comprises sensor means for producing a synchronization signal when at least one of said percussion instruments is being played. The percussion assembly furthermore comprises control means for receiving the tone pitch selection signal and the synchronization signal and for producing an audio signal dependent on the tone pitch selection signal synchronously with the synchronization signal. The invention further relates to drumsticks and to input means for use with a percussion assembly as described in the foregoing.

21 Claims, 5 Drawing Sheets

PERCUSSION ASSEMBLY, AS WELL AS DRUMSTICKS AND INPUT MEANS FOR USE IN SAID PERCUSSION ASSEMBLY

The present invention relates to a percussion assembly comprising a multitude of percussion instruments and means for playing said percussion instruments.

Such percussion assemblies, more commonly known as drum sets, consists of a multitude of percussion instruments, such as drums and cymbals, for producing a rhythmic beat, which may for example be used for accompanying a band. When a piece of music is performed, the accompaniment of the music is provided by the band's rhythm section. The rhythm section consists of a drummer and, in most cases, the bass player or the player of another bass instrument. In the band, the drummer performs a crucial function, as it is the drummer who sets the tempo of the music and thus defines the rhythm. The bass player provides the musical accompaniment of the piece of music and in particular sets the tone of the music. The other instruments play off the beat and the tone as set by the rhythm section, so that the music is played as one.

A good ensemble between the bass player and the drummer in the rhythm section is of major importance, because it is the rhythm section of the band that determines to a large extent how the music being played comes across to the listener. If the drummer and the bass player do not play together well, the music will soon sound sloppy, and in the worst case will be dreadful to hear. If a bass player and a drummer in a band are well-attuned to each other and thus play together well, a harmony is obtained and the music played will sound "tight".

The bass player's ability to synchronise his playing with the rhythm produced by the drummer makes or breaks the ensemble between the drummer and the bass player. If the drummer is not very well able to hold the rhythm, this may lead to the bass player not being able to follow the rhythm, resulting in an unsuccessful ensemble. On the other hand, if the bass player is not very well able to follow the drummer's rhythm, which in itself may be a tight rhythm, the result will likewise be an unsuccessful ensemble.

Since the bass part and the percussion part are played by different persons in a band, synchronisation errors (which in themselves are only human) will easily arise, which synchronisation errors may have disastrous effects on the music being played. To make a good team, the drummer and the bass player as a rule need long practice together. The consequence of this is that if circumstances make it necessary to replace the drummer or the bass player (whether or not temporarily), the drummer and the bass player need to become attuned to each other again, which may be very time-consuming.

Even if the drummer and the bass player are well-attuned to one another, the risk of synchronisation errors occurring between the drummer and the bass player while playing a piece of music cannot be ruled out altogether. Since the playing of instruments is man's handiwork, even a well-attuned rhythm section will make the occasional error.

It is an object of the present invention to provide a solution to the problem of synchronisation errors in the rhythm section of a band.

Consequently, the invention provides a percussion assembly comprising a multitude of percussion instruments, means for playing said percussion instruments and input means for inputting a tone pitch selection for the purpose of producing a tone pitch selection signal, wherein said percussion assembly further comprises sensor means for producing a synchronisation signal when at least one of said percussion instruments is being played, further comprising control means for receiving the tone pitch selection signal and the synchronisation signal and for producing an audio signal dependent on the tone pitch selection signal synchronously with the synchronisation signal.

The percussion assembly according to the present invention enables the drummer to play a bass part in addition to playing the usual percussion part. The control means impeccably synchronise said bass part with the beat produced by the percussion instruments.

The tone pitch selection for producing a tone pitch selection signal is input by the user or drummer himself. In a preferred embodiment, the user does so while playing the percussion part, but it is also possible to programme the tone pitch selection signal into the control means prior to playing the percussion assembly, for example (as will be described hereinafter).

The tone pitch selection signal will be synchronised with the playing of the percussion instruments. The tone pitch selection signal may in particular be synchronised with the playing of a bass drum, for example, which usually sets the basic rhythm in a percussion part.

According to one embodiment of the invention, the means for playing the percussion instruments comprise at least one drumstick, and the input means for inputting a tone pitch selection form part of said at least one drumstick. One or more tone pitch selection switches for selecting the desired tones may be placed on the drumstick, for example.

Since the drummer will generally play the percussion assembly with both hands, it is also possible to provide both drumsticks of the percussion assembly with complementary input means, by means of which all the desired tones in the tone pitch selection signal can be produced. Think of a multitude of buttons in this case, for example, by means of which a scale of at least one octave can be played, with the keys being divided over the two drumsticks.

The input means may be further extended with an octave selection switch and an instrument selection switch, for example. The buttons may be provided along the length of the drumsticks, but the drumsticks may also be provided with panels extending from the drumsticks, on which the keys are present.

The input means may be selected from a group comprising tone pitch selection keys (as described above), selection switches, joysticks and touch controls. The skilled person will appreciate that it is also possible to use equivalent input means.

Although the above-described embodiment, in which the drumsticks are provided with the input means, is the preferred embodiment, it is also possible to incorporate the input means in a different manner in the percussion assembly. It is for example also possible to provide the user with additional foot pedals, by means of which the key selection can be made. According to another option, input means are provided wherein the user can make a tone pitch selection by blowing air against selected sensors by mouth so as to activate said sensors.

The means for playing the percussion instruments may comprise one or more striking implements. The term striking implement is understood to mean a suitably shaped element for playing (striking) the percussion instrument. The above-described drumsticks are examples thereof, but the skilled person may also think of a foot pedal or equivalent striking implements. A foot pedal may be provided with a beater, for example, or be coupled to a hi-hat.

The sensor means for producing the synchronisation signal may in particular be present on one of the striking implements for providing a trigger signal for producing the synchronisation signal each time said at least one striking implement strikes a percussion instrument. A sensor element may for example be placed on the beater of a foot pedal, so that the sensor signal will detect a pulse input each time the bass drum is struck by the foot pedal, which pulse input is converted into the trigger signal. The rhythmic beat of the bass drum will then produce a synchronisation signal consisting of a sequence of pulse signals.

As an alternative to placing the sensor means on at least one of the striking implements, the sensor means may also be disposed at different locations on the drum set. As regards the placement of the sensor means it is important that the sensor means are able to sense one or more percussion instruments being played. The sensor means may also be placed on, for example, a drumhead, cymbals, a hi-hat or a drum edge, therefore, or similar locations on the percussion instruments. A skilled person who has perused the present description will immediately recognise suitable locations for the sensor means.

The sensor means may be selected from a group comprising drum trigger elements, light sensors, switches, microphones or vibration sensors. Those skilled in the art will appreciate, however, that it is also possible to use similar or equivalent sensors.

According to another embodiment, the audio signal is made up of a sequence of tones, wherein the tones are dependent on the tone pitch selection signal and wherein the control means, with a view to producing the audio signal, are arranged for producing at least one tone of said tones when a synchronisation trigger occurs in the synchronisation signal. In this way it is possible, for example, to form a melody with the tones to be produced, which melody is synchronised with the percussion part.

According to another embodiment, the tone pitch selection signal represents a melody, and the control means are arranged for producing the audio signal synchronously with the synchronisation signal, such that a melody rhythm of the melody is synchronised with the synchronisation signal. The underlying idea is that it is not the tones of the melody but the rhythm of the melody that is synchronised with the synchronisation signal of the percussion assembly. In this way it is possible to achieve a faultless synchronisation between highly advanced bass parts and the percussion assembly.

It is also possible to synchronise each second, third, fourth or $N^{th}$ tone, for example, in such a manner that two, three, four or N tones ($\geqq 1$), respectively, are produced each time between two synchronisation triggers in the synchronisation signal.

According to another embodiment of the invention, the control means comprise a memory for storing at least part of the tone pitch selection signal therein. More in particular, a tone pitch selection signal representing a specific bass line melody may already be stored in the control means before the percussion assembly is actually played. The rhythm of the melody that the tone pitch selection signal represents is likewise stored in the control means, and when the percussion assembly is played the stored tone pitch selection signal is synchronised with the synchronisation signal. It is for example even possible in that case to manipulate the already stored tone pitch selection signal with the input means while playing the percussion assembly.

According to another embodiment, the sensor means produce the synchronisation signal when at least one percussion instrument selected from a group comprising acoustic percussion instruments, such as a bass drum, a string drum or cymbals, and electronic percussion instruments is played.

The audio signal to be provided by the control means may be composed of sampled sound signals. Thus it is for example possible to store sampled sound signals from musical instruments in the control means, from where the audio signal can be composed. Said musical instruments may for example be selected from a group comprising electric bass guitars, acoustic bass guitars, fretless bass guitars, slap bass, string bass, finger-style bass, tuba, various synthesizer sounds, such as bass sounds, samples or simulations of existing makes and types of bass instruments, a guitar, wind instruments such as a saxophone or a trumpet, an organ, keyboard instruments such as a piano or a keyboard, and combinations of one or more instruments. Those skilled in the art will appreciate, however, that in addition to the aforesaid musical instruments it is also possible to store other sampled musical instruments or sounds in the control means for producing the audio signal. Those skilled in the art will further appreciate that it is preferable to use bass instruments/sounds for playing a rhythm section.

The invention further relates to a drumstick for use with a percussion assembly as described in the foregoing, wherein the drumsticks comprise input means for inputting a tone pitch selection for the purpose of producing a tone pitch selection signal.

The invention will be described hereinafter on the basis of a few specific embodiment thereof, in which description reference will be made to the appended drawings, in which.

Figure 3:
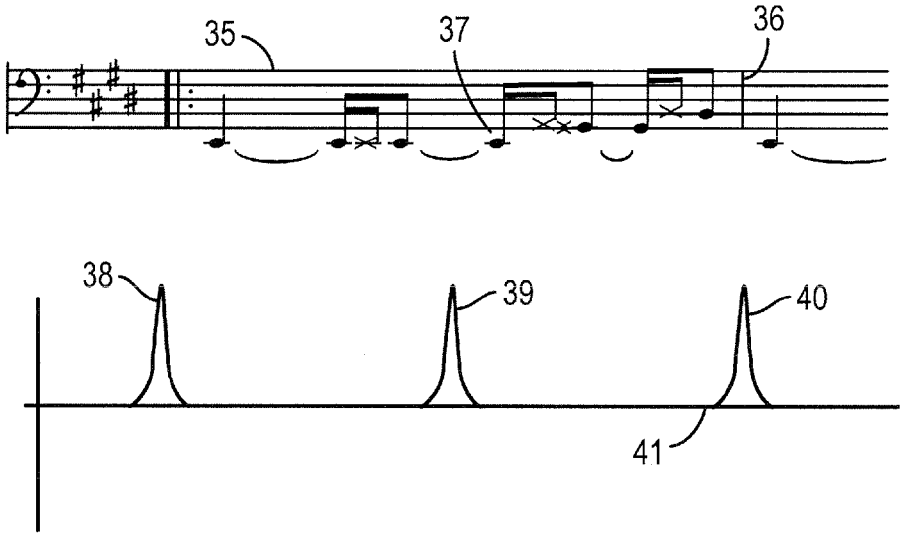
Figure 4:
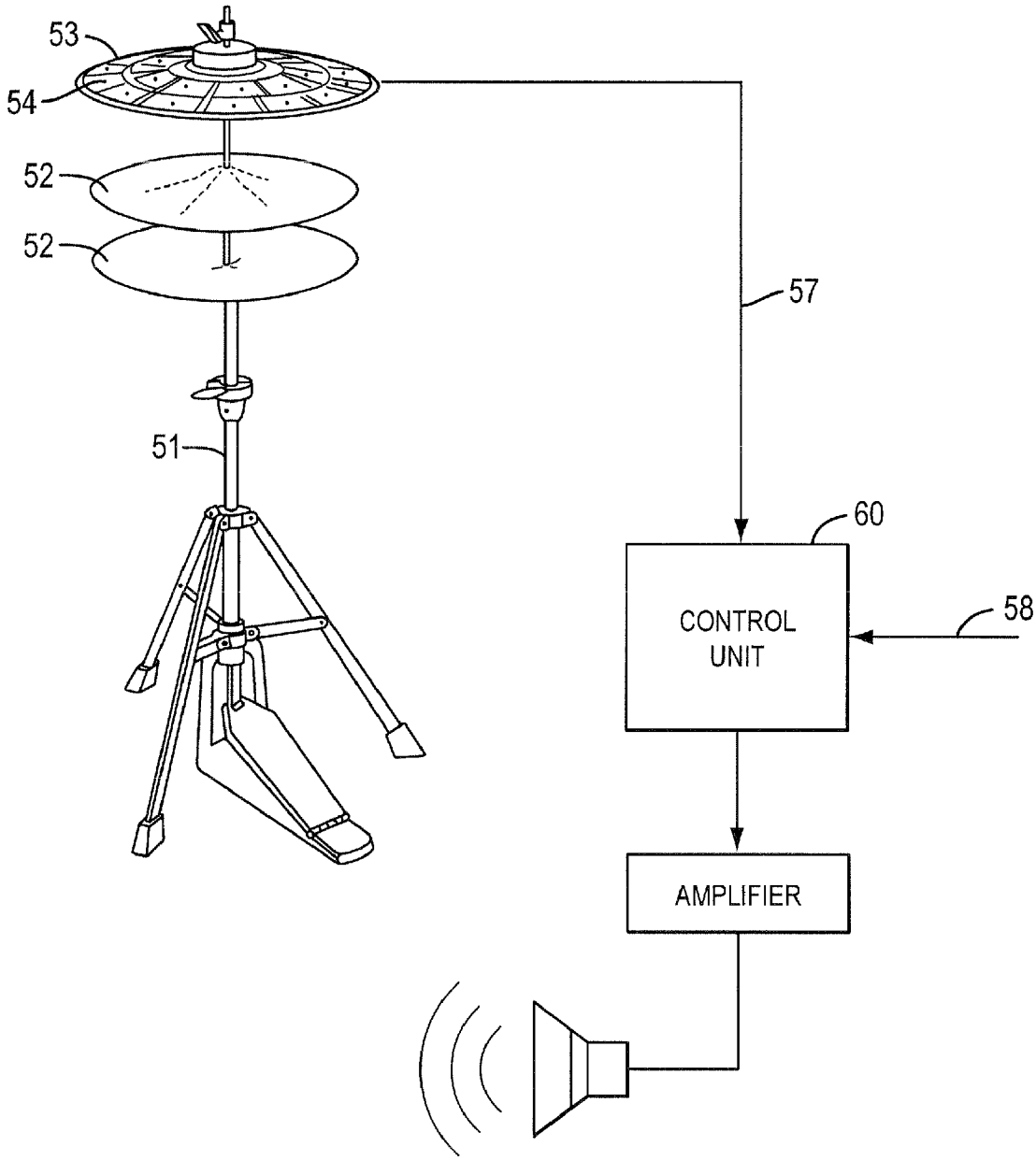

FIG. 3 schematically shows the possible synchronisation of a bass part on the basis of a synchronisation signal;

FIG. 4 schematically shows another embodiment of the present invention; and

Figure 5:
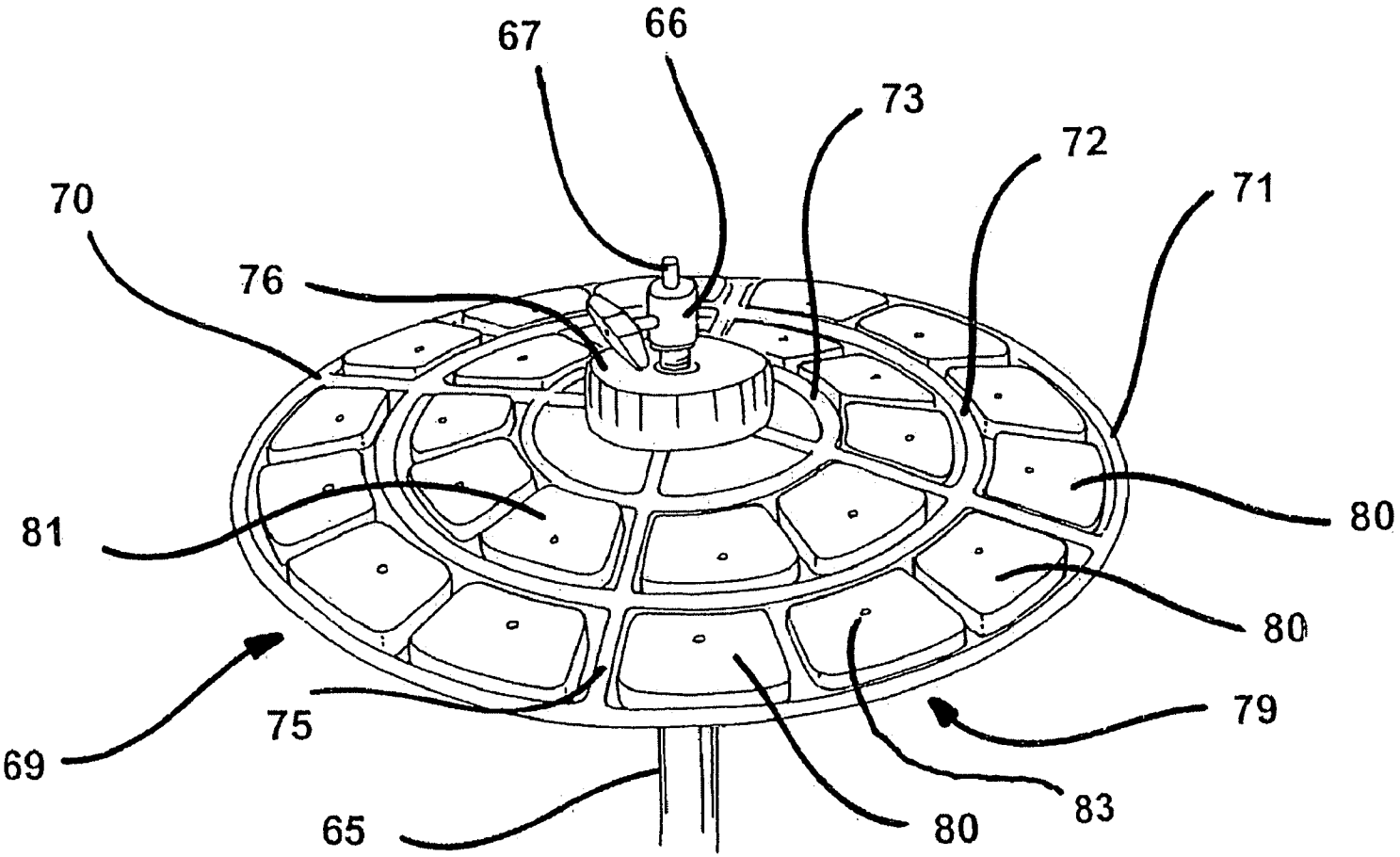

FIG. 5 is a larger-scale view of an embodiment, such as the embodiment shown in FIG. 4.

Figure 1:
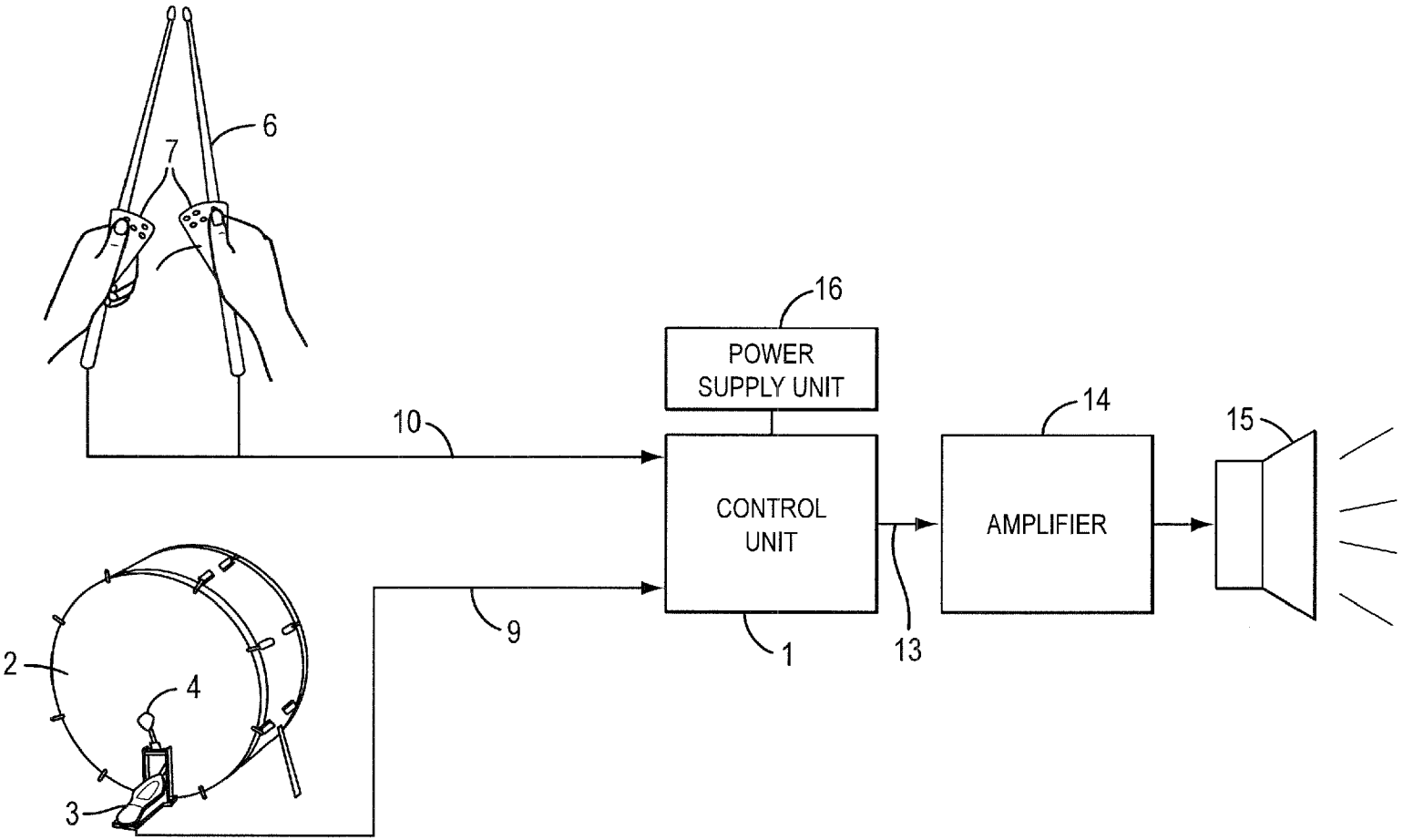
FIG. 1 is a schematic overview of the working principle of a percussion assembly according to the invention.

FIG. 1 schematically illustrates the working principle of a percussion assembly according to the invention. In FIG. 1 only those parts and elements of the percussion assembly that are relevant to the working principle of the invention are shown, whilst all the other parts, such as cymbals, string drums, electronic drum pads and the like, have been left out.

FIG. 1 shows a control unit 1 which is fed with electric power by the power supply unit 16. The control unit 1 is operatively connected to sensor means (not shown) present on the beater 4 of a foot pedal 3 for playing a bass drum 2. The control means 1 are furthermore operatively communicatively connected to input means 7 on drumsticks 7. The sensor means present on the beater 4 of the foot pedal 3 transmit a synchronisation signal (schematically indicated at 9) to the control means 1. The sensor means in particular produce a trigger pulse each time the beater 4 strikes the drumhead of the bass drum 2. In this way a synchronisation 9 is provided when the bass drum 2 is being played by the drummer, which signal is forwarded to the control means 1.

The drummer plays percussion instruments such as string drums, cymbals and the like with his hands and with the drumsticks 6. The drumsticks 6 are provided with input means 7, by means of which the drummer can make a tone pitch selection. The tone pitch selection made by the drummer is forwarded to the control unit 1 as a tone pitch selection signal 10. The power supply unit 16 also provides the drumsticks 6 with the input means 7 with the electric power required for the operation thereof. In a wireless version of the drumsticks 6, the power supply unit 16 may be arranged for charging a battery unit (not shown, for example in the form of one or more rechargeable batteries) that may be present in the drumsticks.

Figure 2:
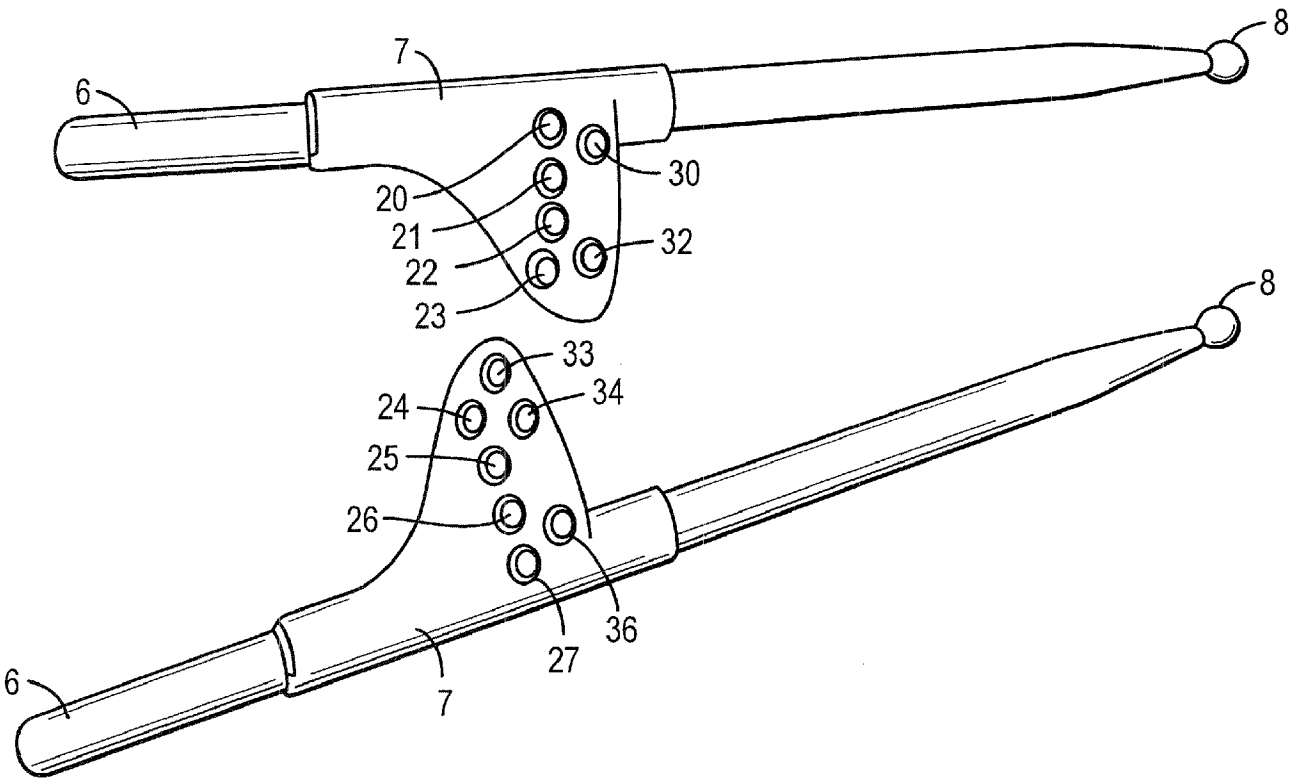
FIG. 2 shows a pair of drumsticks for use with a percussion assembly according to the invention.

The drumsticks 6 are shown on a larger scale in FIG. 2. FIG. 2 shows the drumsticks 6 on which the input means 7 are present. Present at one end of each of the drumsticks 6 is a spherical or (semi) ellipsoidal striking element 8 for playing a percussion instrument. The drumsticks 6 and the input means 7 are so configured that when the drummer holds the drumsticks, he can control the input means 7 with his thumbs. Those skilled in the art will appreciate that the drumsticks 6 and the input means 7 may also be suitably configured in a different manner, so that it is for example possible to control the input means 7 with other fingers.

The input means 7 are attached to the drumsticks 6 and may form an integral part thereof. It is also possible to configure the input means as separate accessories, which can be attached to any suitably shaped set of drumsticks. Those skilled in the art will appreciate that the simple design of the input means 7 as shown in FIG. 2, which consists of a panel on which keys are present and a part that can be connected to the drumsticks 6, can be universally configured, in a manner that is obvious to the skilled person, for use with a large number of drumsticks of varying sizes and shapes.

The input means 7 each comprise a panel on which a multitude of keys are present. The input means 7 on each drumstick 6 shown in FIG. 2 together form a matching whole. A multitude of input keys 20, 21, 22, 23, 24, 25, 26, 27, 30, 32, 33, 34, 36 are present on the input means 7. The input keys 20, 21, 22, 23, 30 and 32 on one drumstick are complementary to the keys 24, 25, 26, 27, 33, 34 and 36 on the other drumstick 6. When the 13 keys on the input means 7 enable the number to play all the tones of a scale. In the present embodiment, white keys are more particularly used for the full tones and black keys are used for the semitones D#/Eb, F#/Gb, G#/Ab, A#/Bb, and C#/Db. In this embodiment, the scale starting with D and ending with D one octave higher has specifically been chosen, because in present-day music the bass instrument likewise starts from a D or an E as the lowest bass note. Those skilled in the art will appreciate that the scale may start with any root note, if desired.

In a special embodiment the root note can be set on the input means 7 in such a manner that the scale that can be formed with the keys 20-27 and 30-36, for example, has the selected root note as its lowest note. In addition to that, the input means may comprise an octave selection key, by means of which the drummer can determine whether the scale being played must possibly be played one octave higher or lower. The key 27 shown in FIG. 2 (which represents the high D of the scale in FIG. 2) is optional. The arrangement of the black and the white keys on the input mean shown in FIG. 2 is such that a "piano structure" for the distribution of the keys can be clearly recognised therein: the white keys, which represent full tones of the scale, form the basis, and slightly staggered between the white keys are the black keys, which represent the semitones. It stands to reason that such a distribution is less suitable for use in an embodiment in which the root note can be preset by the drummer, because if a different root note than D were to be selected, the semitones would also have to be present at a different location on the input means. Those skilled in the art will appreciate, however, that a different design may be used in that case, in which the location of the semitones can be easily adapted, for example. Various solutions are possible in this regard. Furthermore, the use of keys, as shown in FIG. 2, is not essential to the invention. Those skilled in the art will appreciate that also other means may be used by which the drummer can make his tone pitch selection. Think in this connection for example of touch controls, joysticks, selection discs and the like.

The input means 7 shown in FIG. 2 communicate the input tone pitch selection signal wirelessly to the control means 1 (FIG. 1). The advantage of this is that the drummer is free from leads and wires on the drumstick when playing a drum set. Those skilled in the art will appreciate, however, that if wireless input means 7 are used, the input means will depend on their own power supply, for example in the form of a battery in the input means. The skilled person will realise, however, that also hardwire embodiments of the drumsticks are possible, in which case the wires on the drumsticks may optionally be led away via the drummer's limbs, for example using bands or other suitable means, so as not to be in the drummer's way when playing the drum set.

Returning to FIG. 1, the tone pitch selection signal input by the drummer by means of the drumsticks 6 and the input means present thereon is wirelessly communicated to the control means 1, as is schematically indicated at 10. In the control means 1, the tone pitch selection signal 10 and the synchronisation signal 9 come together. On the basis of the tone pitch selection signal 10, the control means 1 provide an audio signal 13 on the output thereof, which audio signal 13 has been synchronised with the synchronisation signal 9. The control means will in particular convert the tone pitch selection made by the drummer into a matching audio signal, for example, which is not released until a synchronisation trigger is registered on the synchronisation signal 9. In other words, because in the present example the synchronisation triggers are produced at a moment when the bass drum 2 is played by means of the beater 4, the tone pitch selection made by the drummer will only be played as an audio signal at the moment when the bass drum 2 is played by the drummer. The melody produced by the drummer is thus correctly synchronised with the playing of the bass drum 2, so that the listener and experience the sound as a finely attuned rhythm section. The percussion part and the basic part form a well-synchronised whole, so that a piece of music being performed will sound "tight" to a listener's ears.

As is shown in FIG. 1, the output signal of the control means 1 is amplified by means of an amplifier 14 and played to the audience by means of the loudspeaker 15.

In the present example the bass line played by the drummer with the input means is synchronised with the playing of the bass drum 2. The sensor means for receiving the synchronisation signal are present on the beater 4 of the foot pedal 3 in this example. The skilled person will appreciate, however, that such sensor means may also be disposed elsewhere in the percussion assembly, for example on the striking elements 8 of the drumsticks 6, or on the control mechanism of the cymbals, for example. In this way the bass line played by the drummer can be synchronised with other percussion elements. Instead of using sensor means present on the striking implements, such as the drumsticks 6 or the foot pedal 3, it is also possible to use different sensors, which are for example directly connected to a specific percussion instrument. In this connection advantageous use may for example be made of vibration sensors, microphones and the like, which can be placed on the percussion instruments. Such sensor is can provide a synchronisation signal when the percussion instrument in question is struck.

In the foregoing the invention has been described by means of an example in which the drummer makes one tone pitch selection each time, which tone pitch selection is subsequently synchronised with a synchronisation signal, wherein control means play the tone pitch selection made by the drummer upon receipt of a synchronisation signal. The skilled person will appreciate that the synchronisation of a bass line does not necessarily have to take place note by note.

The drummer may also play a melody with the input means 7, wherein the time in which the melody is played is synchronised with the drum beats of the bass drum, for example. Both monophonic and polyphonic melodies are possible in this regard. This is for example illustrated in FIG. 3. FIG. 3 schematically shows a musical notation 35 for a bass line. The division of the melody into bars is indicated by bar lines, such as the bar line 36. A musical notation such as the notation 35 is a generally known notation for representing music and requires no further explanation.

FIG. 3 also schematically shows a synchronisation signal 41. The synchronisation signal consists of a series of synchronisation pulses 38, 39, 40, which have been received from a sensor element present on, for example, the beater 4 of a foot pedal 3 for playing a bass drum 2, as is shown in FIG. 1. To achieve a good ensemble of the percussion part with the bass line 35 that is played, the bars of the bass line 35 must be synchronised with the synchronisation pulses of the synchronisation signal 41.

The drummer drums two beats per bar on the bass drum 2, i.e. one strike per half bar. Synchronisation of the bass line 35 being played can now take place in two different ways, for example. According to the first possibility, the control unit is set so that it is already known before playing is started that every bar includes two beats of the bass drum 2. The control unit 1 can in that case synchronise the bass line 35 stored in the memory thereof in such a manner that the melody line is synchronised with every second synchronisation pulse in the synchronisation signal 41, i.e. in particular the pulse 38 or the pulse 40, upon encountering a bar line, such as the bar line 36.

According to a second possibility, the control unit 1 itself determines on the basis of the length of the notes and the prescribed time which note of the melody 35 must be synchronised with, for example, the synchronisation pulse 39 that indicates a half bar. In the present example this is the quarter note 37.

In the above example, the bass line must be input into the control means in advance. If this is the case, very difficult bass parts can be perfectly synchronised with the drummer's play, as appears from the above-described example. In a simpler embodiment, the bass line is not stored in the control means in advance, but it is directly obtained from the input means during play. A major advantage of this is that such an embodiment allows improvisation, which is not possible when the melody is already fixed. In that case a time indication, as in the bass line 35, is not available to the control means, however, and the above-described synchronisation method cannot be used. Synchronisation of the bass line with the percussion part can take place in a different manner, for example, with the bass line being synchronised note by note, as described above, with the percussion part, or with the drummer indicating on the control means in advance that each $N^{th}$ note must be synchronised with the occurrence of a synchronisation pulse. Thus every second or third note that is played can be synchronised by the drummer, for example, so that a tight bass line is obtained yet.

According to another possibility, a previously indicated sequence of tones of a specific duration is set in the control means, and the pitch can be freely selected by the drummer while playing. Thus it is possible to make a setting such that for every tone selected by the drummer on the input means two eighth notes are played upon occurrence of a synchronisation pulse. The synchronisation of a single quarter note with a synchronisation pulse will sound as "to" in the audio signal, for example, whilst the rendering of two eighth notes upon occurrence of a synchronisation pulse sounds as "todo" to the listener's ears. Of course it is possible to fix any sequence of tone durations, as the drummer/user wishes.

FIG. 4 shows another embodiment of the invention, in which the input means are present on a platform 53, which is mounted to the upper side of the cymbals 52 of a hi-hat of a drum set. The cymbals 52 are attached to, for example, a stand 51 in a regular manner. Present on the platform 53 are a multitude of tone pitch selection pads 54, which can be played with drumsticks while playing the hi-hat 52. Playing the pads 54 causes a tone pitch selection signal 57 to be forwarded to the control means 60. The control means 6 view also receive the synchronisation signal 58 consisting of trigger pulses from the bass drum (not shown).

FIG. 5 is a larger-scale view of the embodiment of FIG. 4, in particular of the tone selection device 69 consisting of the platform 70, which can be placed on top of a hi-hat.

FIG. 5 shows a part of the stand 65, and an adjusting screw 66, by means of which the height of the hi-hat and the tone selection device 69 on the stand 65 can be set. The hi-hat (not shown) as well as the tone selection device 69 are mounted to a support pin 67 of the stand 65. The arrow 79 points to the bottom side of the platform 69, and consequently indicates the hi-hat (not shown in FIG. 5) that is present below the tone selection device 69.

The platform 70 consists of three concentric rings 71, 72 and 73, which are connected to connecting elements 75. Centrally disposed on the platform 70 is a mounting ring 76, via which the platform 70 is mounted to the support pin 67 of the stand 65, above the hi-hat (not shown). The concentric rings 71, 72 and 73 and the connecting elements 75 define eight areas, in which a multitude of tone selection pads 80 and 81 are mounted. The tone selection pads may comprise an electronic circuit for producing a tone pitch selection signal of a specific tone pitch, for example. It is also possible that central electronics in the device 69 produce the tone pitch selection signal on the basis of the pad being struck, for example 80 or 81. The tone selection pads 80 and 81 are so arranged that the outer ring is used for the full tones, whilst the inner ring of tone selection pads 81 is used for semitones. The device may furthermore be provided with means for rotating the hi-hat while playing, so as to make all the tone selection pads on the concentric rings readily accessible to the drummer.

The device 69 may furthermore be designed in such a manner that when the tone selection pads 80 or 81 are played, the hi-hat is also played. In the present embodiment this has been realised by means of adjusting screws, such as the adjusting screw 83, via which the tone selection pads 80 and 81 are mounted to the platform. In FIG. 5 the adjusting screws are shown in the centre of each tone selection. The adjusting screws can be used for setting the height of the tone selection pads 80, 81 above the upper symbol of the hi-hat 79 and, in addition, the adjusting screw can provide the electrical contact between the pad 80, 81 and a signal line (not shown) for forwarding a tone selection signal. The adjusting screws may furthermore be set so that striking the pad 80, 81 in question will not lead to the hi-hat 79 being struck. This may be impractical, however, because the drummer does not wish to be bothered with adjusting the adjusting screws while playing the drum set. In the alternative case, the selective disconnection of the hi-hat 79 and the tone selection pads 80, 81 from each other can be realised by making the entire platform 70 adjustable, using suitable means (not shown), with respect to the hi-hat, for example by means of an additional foot pedal. To be able to play the hi-hat 79 independently, without the tone selection pads 80, 81, the hi-hat, unlike the situation shown in FIG. 5, may have a larger diameter than the platform 70, so that the hi-hat can be played independently of the tone selection pads without tone selection signals being generated.

The invention has been described in the foregoing on the basis of a few, non-limitative specific embodiments thereof. Those skilled in the art will appreciate, however, that the working principle of the invention can be implemented in many different ways and be adapted for different purposes. The scope of the present patent specification is only limited by the appended claims.

The invention claimed is:

1. A percussion assembly comprising a multitude of percussion instruments for enabling the playing of a percussion part, means for playing said percussion instruments and input means for inputting a tone pitch selection for the purpose of producing a tone pitch selection signal, characterized in that said percussion assembly further comprises sensor means for producing a synchronisation signal when at least one of said percussion instruments is being played, further comprising control means for receiving the tone pitch selection signal and the synchronisation signal and for producing in addition to said percussion part an audio signal dependent on the tone pitch selection signal synchronously with the synchronisation signal.

2. A percussion assembly according to claim 1, wherein the means for playing the percussion instruments comprise at least one drumstick, wherein said at least one drumstick comprises said input means.

3. A percussion assembly according to claim 1, characterised in that the input means are selected from a group comprising tone pitch selection keys, selection switches, joysticks and touch controls.

4. A percussion assembly according to claim 1, wherein said input means are arranged for selecting tones of a scale of at least one octave.

5. A percussion assembly according to claim 4, wherein said input means are arranged for setting the root of the scale.

6. A percussion assembly according to claim 1, wherein the means for playing the percussion instruments comprise one or more striking implements.

7. A percussion assembly according to claim 6, wherein said striking implements have been selected from the group comprising a drumstick and a foot pedal provided with a striking implement.

8. A percussion assembly according to claim 1, wherein the sensor means are present on at least one of the striking implements for providing a trigger signal for producing the synchronisation signal when said at least one striking implement strikes a percussion instrument.

9. A percussion assembly according to claim 1, wherein the sensor means are suitably disposed on at least one of the percussion instruments.

10. A percussion assembly according to claim 1, wherein said the sensor means comprise at least one element selected from a group comprising drum trigger elements, light sensors, switches, microphones or vibration sensors.

11. A percussion assembly according to claim 1, wherein the audio signal is made up of a sequence of tones, wherein the tones are dependent on the tone pitch selection signal and wherein the control means, with a view to producing the audio signal, are arranged for producing at least one tone of said tones when a synchronisation trigger occurs in the synchronisation signal.

12. A percussion assembly according to claim 11, wherein the tone pitch selection signal represents a melody, and the control means are arranged for producing the audio signal synchronously with the synchronisation signal, such that a melody rhythm of the melody is synchronised with the synchronisation signal.

13. A percussion assembly according to claim 12, wherein the control means comprise a memory for storing at least part of the tone pitch selection signal therein.

14. A percussion assembly according to claim 1, wherein said input means further comprise octave selection means for selecting an octave.

15. A percussion assembly according to claim 1, wherein the synchronisation signal is produced in dependence on at least one percussion instrument selected from a group comprising acoustic percussion instruments, such as a bass drum, a string drum or cymbals, and electronic percussion instruments being played.

16. A percussion assembly according to claim 1, wherein the control means are arranged for composing the audio signal from sampled sound signals.

17. A percussion assembly according to claim 16, wherein, to imitate musical instruments, the sampled sounds sound like at least one musical instruments selected from a group comprising electric bass guitar, acoustic bass guitar, fretless bass guitar, slap bass, string bass, finger-style bass, tuba, various synthesizer sounds, such as bass sounds, samples or simulations of existing makes and types of bass instruments, a guitar, wind instruments such as a saxophone or a trumpet, an organ, keyboard instruments such as a piano or a keyboard, and combinations of one or more instruments.

18. A percussion assembly according to claim 9, further comprising an input device, which input device comprises the input means, wherein the input device is arranged for being mounted to a percussion instrument, such as a hi-hat or a drum.

19. A drumstick for use with a percussion assembly according to claim 2, wherein the drumsticks comprise at least one drumstick comprises input means for inputting a tone pitch selection for the purpose of producing a tone pitch selection signal.

20. A drumstick according to claim 19, wherein said input means are made up of a multitude of input keys for producing the tones of a scale of at least one octave.

21. Input means for inputting a tone pitch selection for producing a tone pitch selection signal, which input means are designed for being attached to a drumstick according to claim 19 for use with said percussion assembly.

* * * * *